US011903490B2

(12) United States Patent
Duncan et al.

(10) Patent No.: US 11,903,490 B2
(45) Date of Patent: Feb. 20, 2024

(54) CUSHION CLIP

(71) Applicants: William Stuart Duncan, Georgetown, SC (US); Sherri Duncan, Georgetown, SC (US)

(72) Inventors: William Stuart Duncan, Georgetown, SC (US); Sherri Duncan, Georgetown, SC (US)

( * ) Notice: Subject to any disclaimer, the term of this patent is extended or adjusted under 35 U.S.C. 154(b) by 0 days.

(21) Appl. No.: 17/471,450

(22) Filed: Sep. 10, 2021

(65) Prior Publication Data

US 2022/0079350 A1 Mar. 17, 2022

Related U.S. Application Data

(60) Provisional application No. 63/078,415, filed on Sep. 15, 2020.

(51) Int. Cl.

| | |
|---|---|
| ***A47C 31/10*** | (2006.01) |
| ***A44B 11/02*** | (2006.01) |
| ***A47C 31/02*** | (2006.01) |
| ***A44B 11/04*** | (2006.01) |

(52) U.S. Cl.
CPC ..... *A47C 31/023* (2013.01); *A44B 11/04* (2013.01); *Y10T 24/316* (2015.01)

(58) Field of Classification Search
CPC ..... A47C 31/023; Y10T 24/316; A44B 11/04
USPC ..... 297/219.1–229
See application file for complete search history.

(56) References Cited

U.S. PATENT DOCUMENTS

| | | | | |
|---|---|---|---|---|
| 3,218,686 | A * | 11/1965 | Rubenstein | A44B 11/04 24/198 |
| 3,919,740 | A * | 11/1975 | Scherb | A22C 15/006 24/301 X |
| 4,858,285 | A | 8/1989 | Dala et al. | |
| 4,910,835 | A * | 3/1990 | Carpenter | F16G 11/14 24/129 R |
| 5,005,903 | A * | 4/1991 | Minardi | B60N 2/2881 297/219.12 |
| 5,199,135 | A * | 4/1993 | Gold | B65D 63/18 24/17 AP |
| 5,441,789 | A | 8/1995 | Walker | |
| 5,590,545 | A * | 1/1997 | Norris | A41F 15/02 24/563 X |
| 5,715,578 | A * | 2/1998 | Knudson | B65D 63/10 24/17 AP |
| 5,802,681 | A * | 9/1998 | Riley | A47C 31/11 297/228.11 |
| 5,867,873 | A | 2/1999 | Arend | |
| 6,655,736 | B1 * | 12/2003 | Arenas | B60N 2/6063 297/229 |
| 6,659,551 | B1 * | 12/2003 | Arenas | B60N 2/6063 297/229 |

(Continued)

*Primary Examiner* — Rodney B White
(74) *Attorney, Agent, or Firm* — Carlson, Gaskey & Olds, P.C.

(57) ABSTRACT

A clip for securing a cushion to an outdoor furniture item is disclosed. The clip includes a middle portion, a first end portion extending transverse to the middle portion and a second portion that extends transverse from the middle portion. The middle portion is longer than each of the first end portion and the second end portion. The end portions are configured to fit through and overlap portions of a loop in the cushion to hold the cushion to a rail of the furniture item.

9 Claims, 6 Drawing Sheets

(56) References Cited

U.S. PATENT DOCUMENTS

| | | | | |
|---|---|---|---|---|
| 6,676,209 | B1 * | 1/2004 | Szabo | B60R 7/043 297/229 |
| 6,842,948 | B2 * | 1/2005 | Smith | F16L 3/233 24/30.5 R |
| 7,278,900 | B1 * | 10/2007 | Ostaseski | A41F 15/02 24/301 |
| 7,517,013 | B1 * | 4/2009 | Lowe | B60N 2/6054 297/228.1 X |
| 7,856,698 | B2 * | 12/2010 | Hays | B65D 63/109 24/129 R |
| 8,042,870 | B2 * | 10/2011 | Cortellazzi | B60N 2/6054 297/219.1 |
| 8,534,755 | B2 * | 9/2013 | Nickerson | A47C 7/0213 297/219.1 |
| 8,733,836 | B2 * | 5/2014 | Gross | A47C 31/11 297/228.12 X |
| 8,910,347 | B1 * | 12/2014 | Wilcox | B65D 63/109 24/30.5 R |
| 11,311,081 | B2 * | 4/2022 | Millward | A44B 11/04 |
| 2011/0272982 | A1 * | 11/2011 | McDonald | B60N 2/60 297/219.1 |
| 2012/0242126 | A1 * | 9/2012 | Burns | A47C 31/11 297/228.12 |
| 2013/0320721 | A1 * | 12/2013 | Cortellazzi | B60N 2/663 297/224 |
| 2014/0265482 | A1 * | 9/2014 | Daley | B60N 2/28 297/219.1 |
| 2016/0129819 | A1 * | 5/2016 | Johnson, Jr. | B60N 2/5891 297/219.1 |
| 2020/0268091 | A1 * | 8/2020 | Lacy | A42B 1/02 |

* cited by examiner

CUSHION CLIP

CROSS REFERENCE TO RELATED APPLICATION

This application claims priority to U.S. Provisional Application No. 63/078,415 filed on Sep. 15, 2020.

TECHNICAL FIELD

The present disclosure relates to device for securing cushions to a chair or couch, particularly for outdoor furniture.

BACKGROUND

Traditional outdoor furniture may include removable cushions. Outdoor furniture is exposed to the elements and eventually the cushions become faded and worn and are replaced. Cushions may include ties to secure the chair to the specific piece of furniture. A loop is sometimes provided on the cushion. However, a loop is particularly useful by itself for securing to furniture. Some cushions includes two strands that are knotted around the furniture item. A knot formed of fabric and exposed to the elements becomes very difficult to remove without resorting to cutting.

The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A clip for securing a cushion to a furniture item according to an exemplary embodiment of this disclosure includes, among other possible things a middle portion, a first end portion extending transverse to the middle portion and a second portion that extends transverse from the middle portion. The middle portion is longer than each of the first end portion and the second end portion. Both end portions are configured to fit through and overlap portions of a loop in the cushion to hold the cushion to a rail of the furniture item.

A cushion assembly for a furniture item according to another exemplary embodiment of this disclosure includes, among other possible things, a cushion including at least one securement portion and a clip that is engageable at least one securement portion of the cushion for holding the cushion to a portion of the furniture item. The clip includes a middle portion, a first end portion extending transverse from the middle portion, and a second end portion extending transvers from the middle portion. The middle portion is longer than each of the first end portion or the second end portion.

A method of assembling a cushion to a furniture item according to anther exemplary embodiment of this disclosure includes, among other possible things, pulling a securement portion attached to a cushion around a frame portion of a furniture item, inserting a first portion of a clip into a first part of the securement portion above the frame portion and inserting a second portion of the clip into a second part of the securement portion below the frame portion.

Although the different examples have the specific components shown in the illustrations, embodiments of this disclosure are not limited to those particular combinations.

It is possible to use some of the components or features from one of the examples in combination with features or components from another one of the examples.

These and other features disclosed herein can be best understood from the following specification and drawings, the following of which is a brief description.

DETAILED DESCRIPTION

Figure 2:
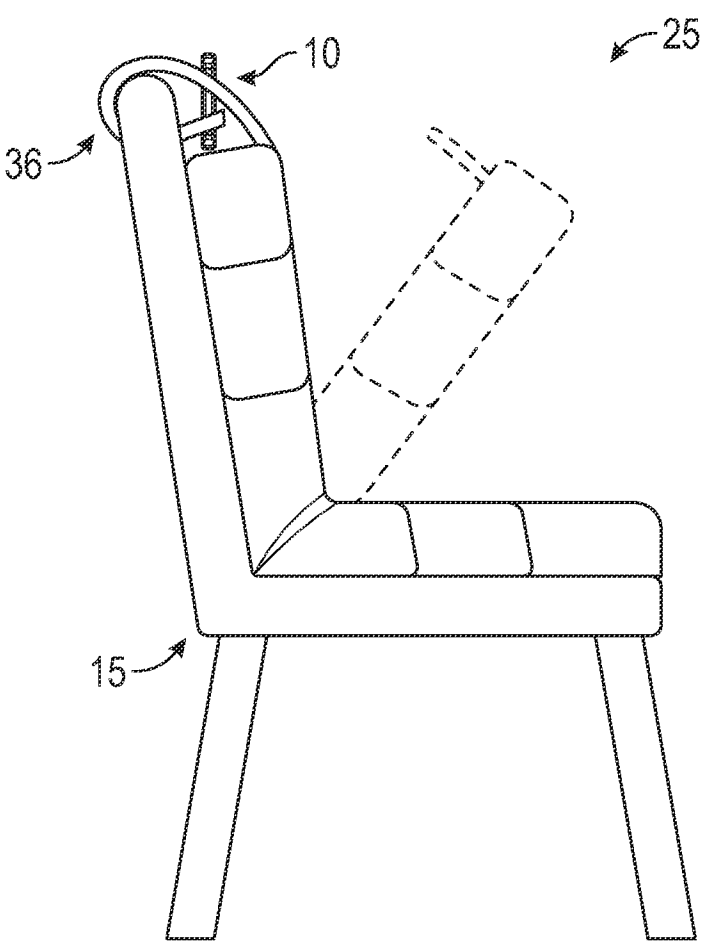
FIG. 2 is a side view of the example furniture item and cushion assembly.
Figure 1:
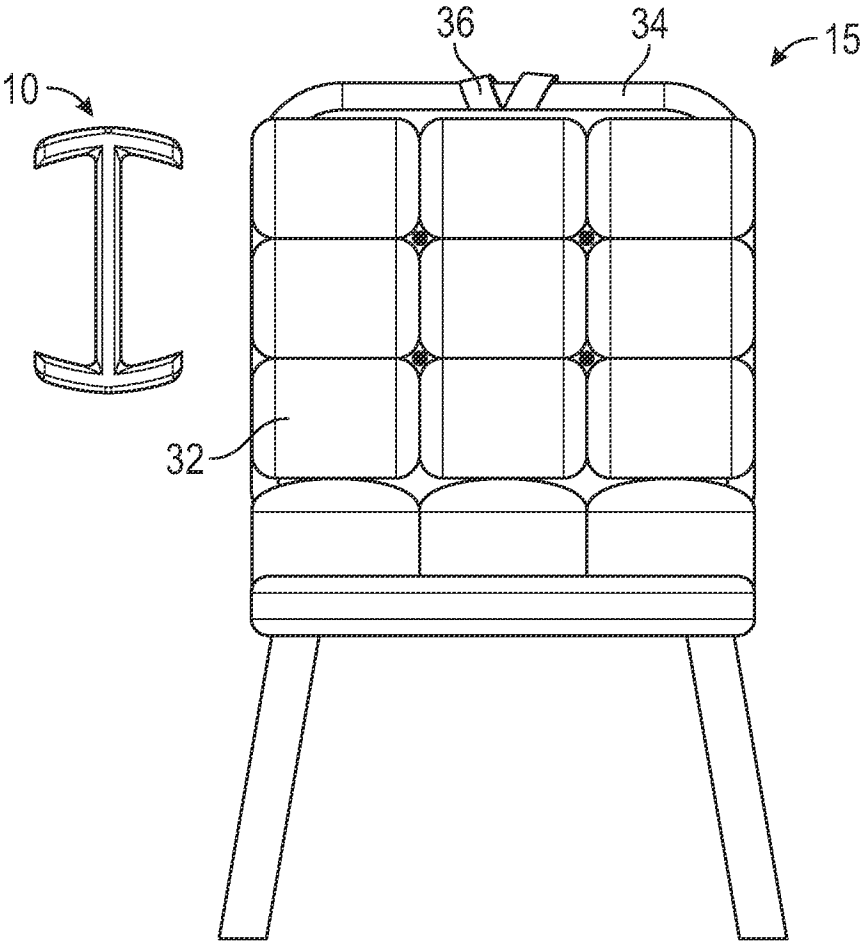
FIG. 1 is a front view of an example furniture item and cushion assembly according to an example embodiment.

Referring to FIGS. 1 and 2, an example furniture item 15 includes a removable and replaceable cushion assembly 25. The cushion assembly 25 includes a cushion 32 and a clip 10. The cushion 32 may be prone to flipping forward as is shown in dotted lines in FIG. 2. The example cushion 32 includes a securement portion in the form of loop 36 that is securable to a portion of the furniture item with the clip 10. In this example, only one loop 36 is provided, but several loops 36 could be present and are within the contemplation of this disclosure. The clip 10 secures the loop 36 to the furniture item without any tying or knots.

The disclosed example furniture item 15 is a chair, however, other furniture arrangements and configurations are within the contemplation of this disclosure. Additionally, the example loop 36 is a continuous uninterrupted loop, the loop 36 could be formed by tying two strand members together and still work with the example clip 10. Accordingly, a cushion with a single continuous loop as shown and a cushion with two strand members would benefit from and are within the contemplation and scope of this disclosure.

Figure 3:
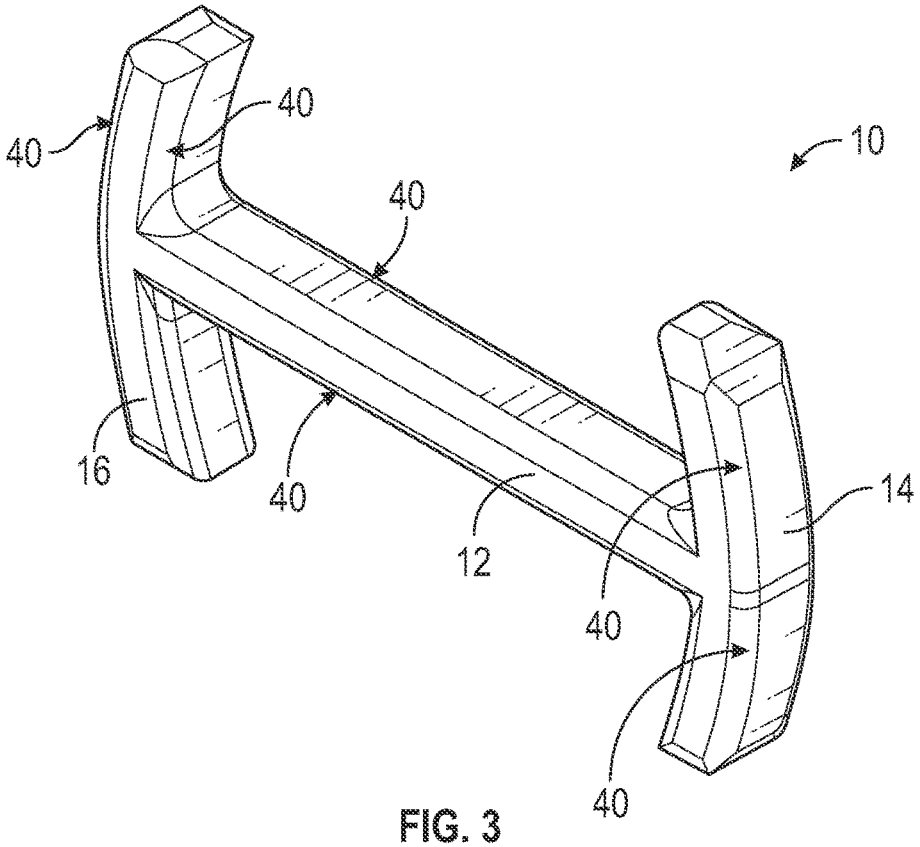
FIG. 3 is a perspective view of an example clip embodiment for securing a cushion to an item of furniture.
Figure 4:
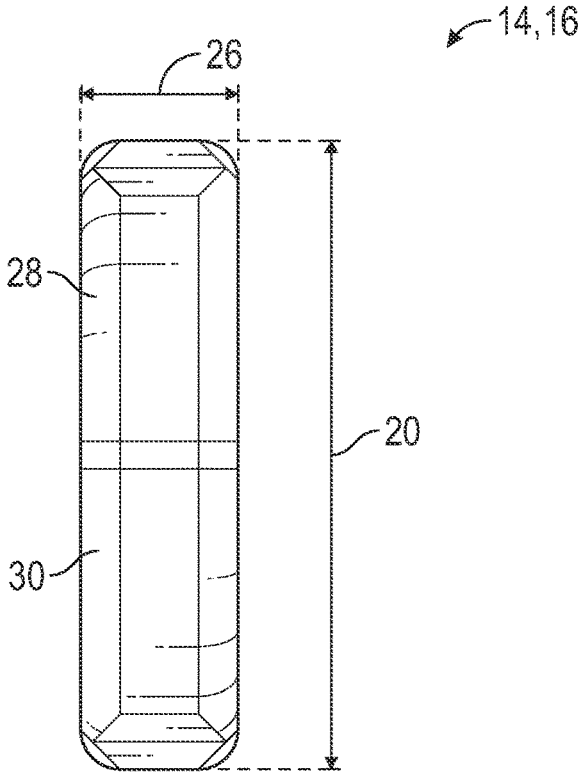
FIG. 4 is a side view of the example clip.
Figure 5:
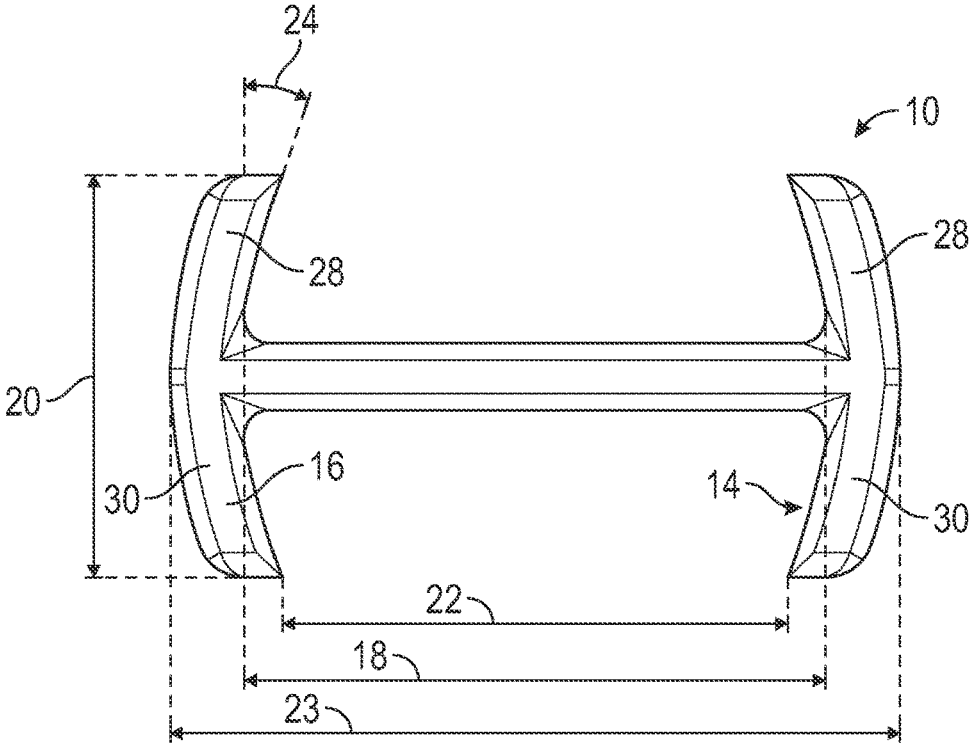
FIG. 5 is an end view of the example clip.

Referring to FIGS. 3, 4 and 5 with continued reference to FIGS. 1 and 2, the example clip 10 includes a middle portion 12, a first end portion 14 and a second end portion 16. The end portions 14, 16 engage the cushion loop 36 to hold the loop 36 around a portion of the chair as shown in FIG. 2.

The end portions of the clip 14, 16 are tapered inward to define a spacing 22 therebetween. The taper begins a base length 18 and tapers inward to the spacing 22. The length 18 is greater than the spacing 22. The taper between the base length 18 and the spacing 22 is provided by a continuous inward angle 24. The taper is defined by the spacing 22 at distal ends of each of the end portions 14, 16 being between about 80% and 95% of the length 18. In one disclosed embodiment, the spacing 22 is about 90% of the length 18. Moreover, the spacing 22 is between about 65% and 75% of the overall longitudinal length 23. In one disclosed embodiment, the spacing 22 is about 70% of the overall longitudinal length 23.

Each of the end portions 14, 16 include a first arm 28 and a second arm 30 that extend outward from the middle portion 12 transverse to a longitudinal length 23. The disclosed clip 10 is a single unitary molded part. Accordingly, the middle portion 12, first end portion 14 and second end portion 12 are all parts of single unitary item.

In one disclosed example, the clip 10 is a single unitary molded item formed from a plastic material. Other materials could also be utilized, such as for example, wood and metal materials. Moreover, although all of the portions 12, 14 and 16 are formed from the same material, each portion could be made from different materials and joined to form the recited clip configuration. The clip 10 may also be formed from separate parts that are attached to each other.

In one disclosed example, edges 40 of the clip 10 are chamfered to eliminate sharp edges. All of the portions 12,14 and 16 are of a common thickness 26.

The end portions 14, 16 have the same width 20. The common width 20 is provided at a width that is sufficient to overlap the loop 36 when assembled to hold the cushion 32 in place. In one disclosed example, the width 20 is between about ½ the overall length 23. In another disclosed example, the width 20 is between ½ and ¾ the overall length 23.

Figure 6:
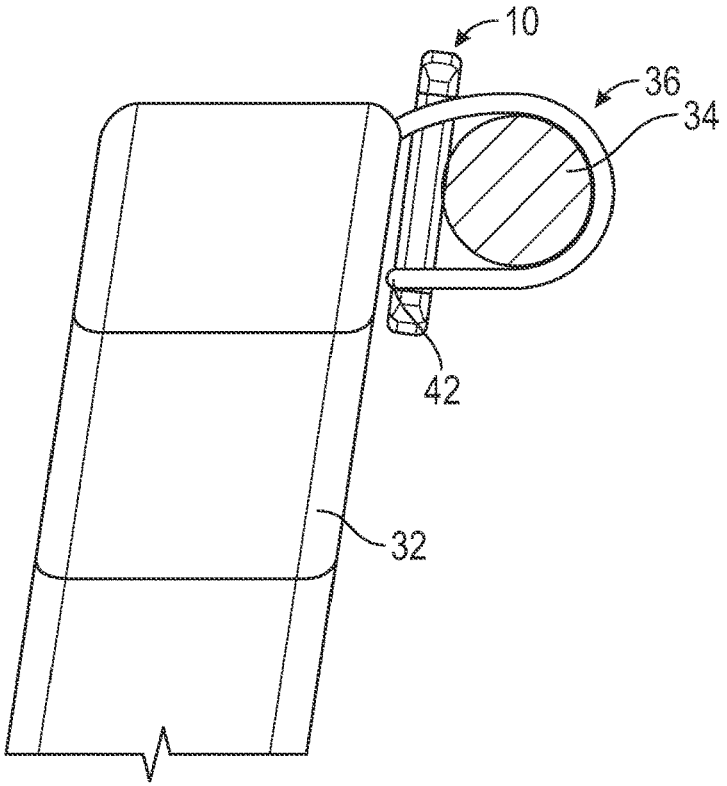
FIG. 6 is a schematic view of a portion of a cushion with a loop.
Figure 7:
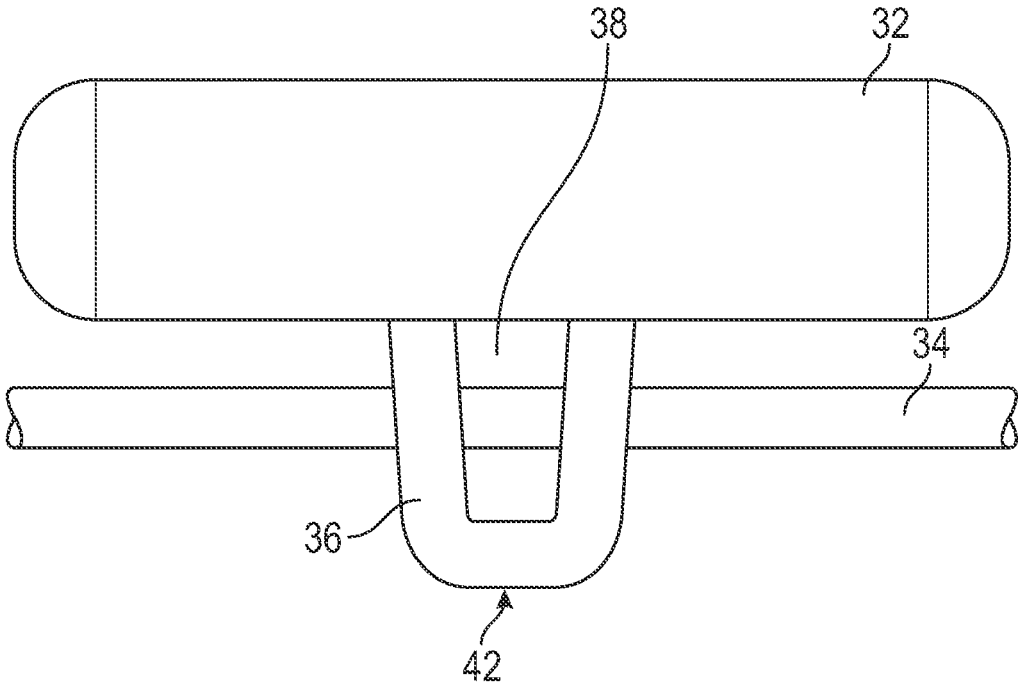
FIG. 7 is a schematic side view of the example clip assembled to the loop of a cushion.
Figure 8:
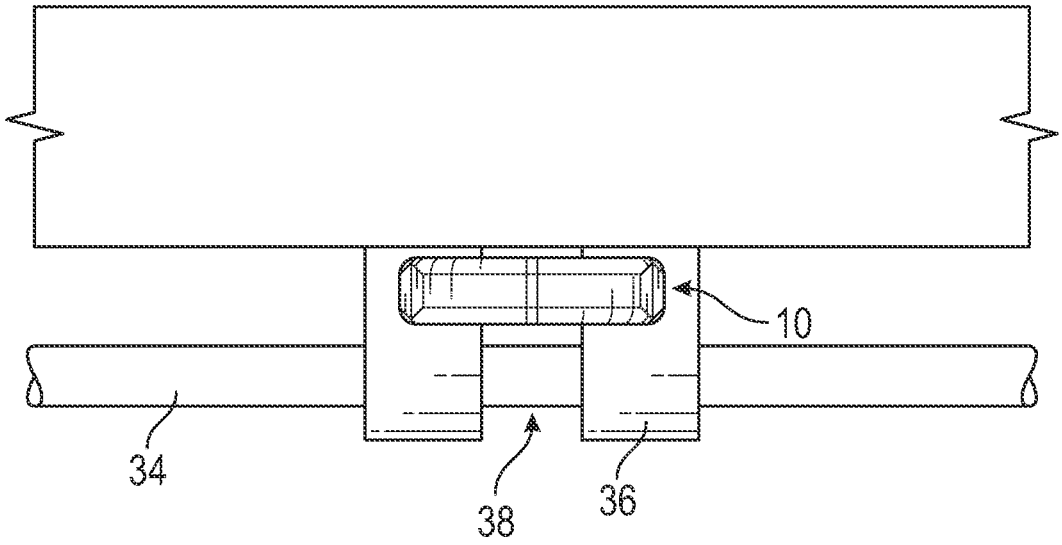
FIG. 8 is a schematic top view of the example clip assembled to the loop of the cushion.

Referring to FIGS. 6, 7 and 8 with continued reference to FIGS. 1 and 2, the example clip 10 extends through an opening 38 of the loop 36 of the cushion 32. The clip 10 secures the loop 36 around a portion of the furniture item 15. In this example, the loop 36 fits around a rail 34. A free end 42 of the loop 36 extends away from the cushion 32. The free end 42 of the loop is wrapped around the rail 34. One of the end portions 14, 16 is placed through the free end 42 and arranged such that the arms 28, 30 overlap portions of the loop 36. The other one of the end portions 14, 16 is placed through the opening 38 in the loop at a portion of the loop 36 that is wrapped over the top of the rail 34. The portion of the loop 36 engaged at the top of the rail 34 is near the cushion 32. The tapered end portions 14, 16 hold the clip 10 in a proper orientation to within the loop 36 and against the rail 34. Tension on the loop 36 provides for a further securement of the clip 10 by closing the opening on itself, making it more difficult for the extends ends of the clip 10 to errantly come free. It should be appreciated that although in the disclosed example, the loop 36 is wrapped over the top of the rail 34, the loop 36 could be wrapped from the bottom of the rail 34 and still enable the clip 10 to be inserted through the opening 38 and hold the cushion 32 in place.

Figure 9:
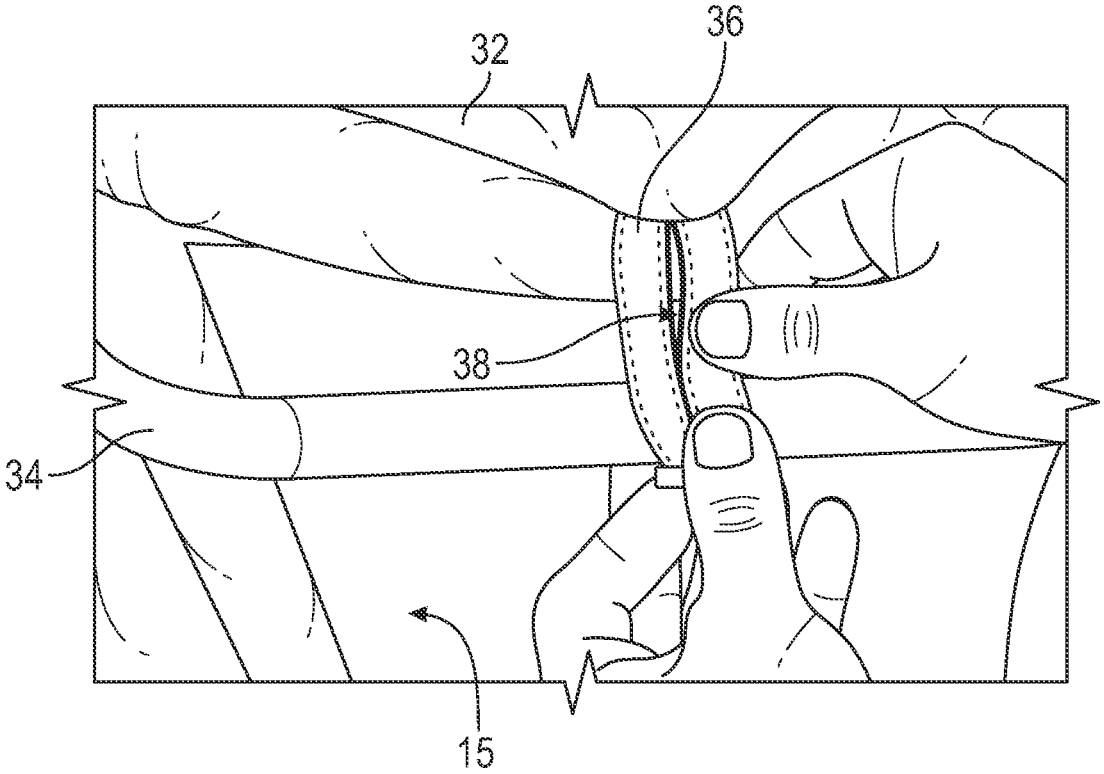
FIG. 9 is a picture of a cushion loop prior to being secured to a chair rail with the clip.
Figure 10:
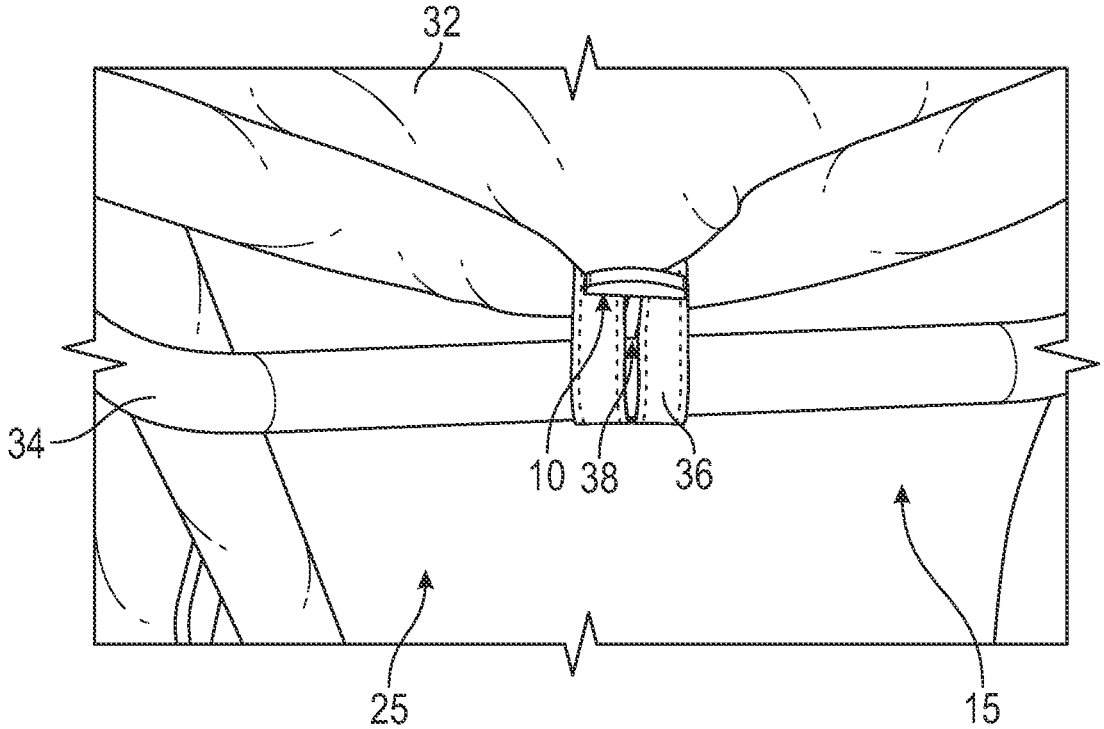
FIG. 10 is a picture of the cushion loop secured with the clip to the chair.

Referring to FIGS. 9 and 10, an example method of assembling a cushion to a furniture item 15 is schematically shown. In an initial step, the loop 36 is pulled outward from the cushion 32 and wrapped about the rail 34. In this example, the loop 36 is pulled over a top of the rail 34, however, the loop 36 may also be pulled under the rail 34 first and then wrapped over the top. The clip 10 is then inserted through the opening 38 in the loop 36 and arranged such that the arms 28, 30 of one of the end portions 14, 16 crosses over sides of the loop 36. Both the first end portion 14 and the second end portion 16 extend out over the loop 36 in a wrapped orientation around the rail 34 as best shown in FIG. 10.

Figure 11:
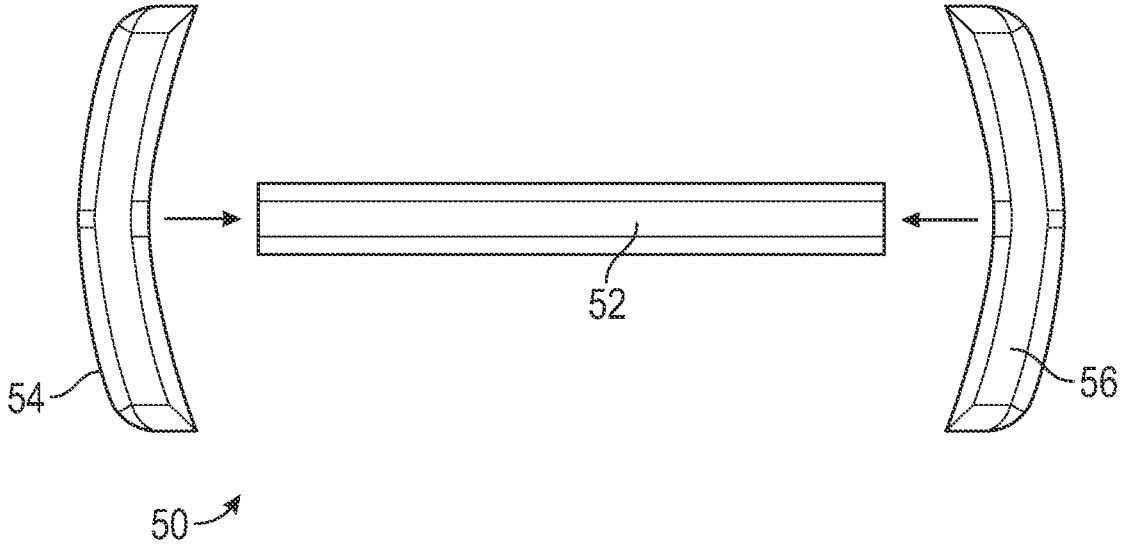
FIG. 11 is an exploded side view of another example disclosed clip embodiment.
Figure 12:
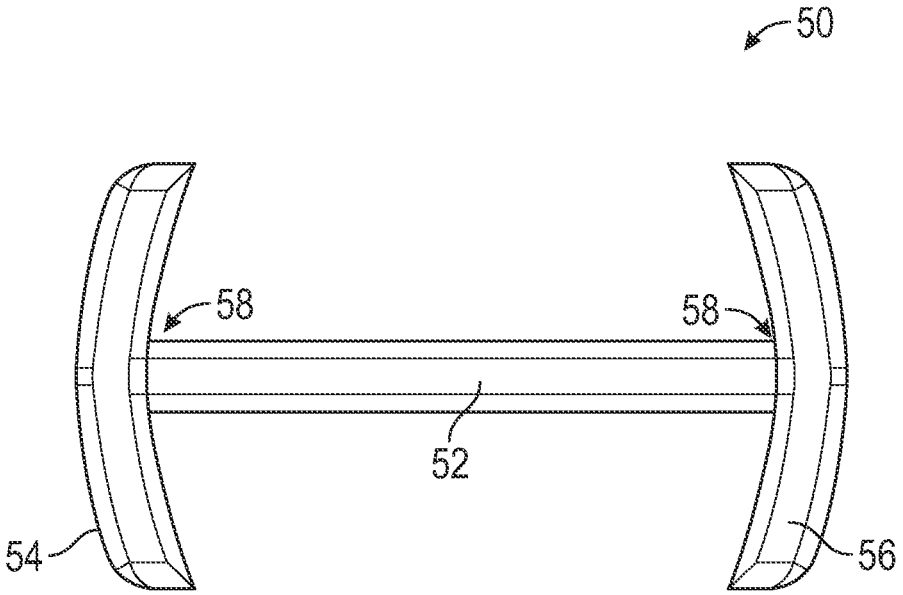
FIG. 12 is a side view of the example disclosed clip of FIG. 11.

Referring to FIGS. 11 and 12, another example clip 50 is schematically shown. The example clip 50 includes separate portions that are attached at a joint 58. A first end portion 54 and a second end portion 56 are attached to distal ends of a middle portion 52. The first and second end portions 54, 56 and the middle portion 52 may be formed of the same or different material. In this example, the portions 54, 56 a 52 are formed from a plastic material. The joints 58 could be formed utilizing adhesive or mechanical fastener.

Accordingly, the disclosed clips, 10, 50 provide for provide for securement of a cushion 32 to a furniture item without knots while also providing easy removal. Moreover, the disclosed clips 10, 50 can be applied to hold the cushion in place without alteration of the cushion or the loop.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A cushion assembly for a furniture item, the cushion assembly comprising:

a cushion including a loop portion; and a clip engageable to the loop portion of the cushion in at least two places on the loop portion for holding the cushion to a portion of the furniture item, the clip including a middle portion, first end portion extending transverse from the middle portion, and a second end portion extending transvers from the middle portion, wherein the middle portion is longer than each of the first end portion or the second end portion and each of the first end portion and the second end portion of the clip include a first arm and a second arm extending in a direction away from each other.

2. The cushion assembly as recited in claim 1, wherein a longitudinal length of the middle portion is longer than a length of either the first end portion or the second end portion.

3. The cushion assembly as recited in claim 2, wherein the first arm and the second arm of each of the first end portion and the second end portion are tapered inwardly.

4. The cushion assembly as recited in claim 3, wherein a spacing between the first end portion and the second end portion at an end distal from the middle portion is between about 80% and 95% of a base length between the first end portion and the second end portion at the middle portion.

5. The cushion assembly as recited in claim 1, wherein the middle portion, first end portion and the second end portion are a single molded item.

6. The cushion assembly as recited in claim 1, wherein the middle portion, the first end portion and the second end portion are disposed within a common plane and a thickness of the middle portion, first end portion and second end portion are the same, wherein the thickness is in a direction transverse to longitudinal length of the middle portion.

7. A method of assembling a cushion to a furniture item comprising:

pulling a loop attached to a cushion around a frame portion of a furniture item;

inserting a first portion of a clip into a first part of the loop portion above the frame portion; and inserting a second portion of the clip into a second part of the loop portion below the frame portion.

8. The method of assembling a cushion as recited in claim 7, wherein the first part is pulled over top of the frame portion and the second part is looped around the frame portion.

9. The method of assembling a cushion as recited in claim 8, wherein the clip includes a middle portion, first end portion extending transverse from the middle portion, and a second end portion extending transvers from the middle portion, wherein the middle portion is longer than each of the first end portion or the second end portion.

* * * * *